US005554077A

United States Patent [19]

Coles

[11] Patent Number: 5,554,077

[45] Date of Patent: Sep. 10, 1996

[54] BALL DISPENSER

[76] Inventor: Roy Coles, Box 13, Mallard Drive, Nanoose Bay, British Columbua, Canada, V0R 2R0

[21] Appl. No.: 608,876

[22] Filed: Feb. 29, 1996

[51] Int. Cl.[6] ..... A63R 57/00; B65D 85/00

[52] U.S. Cl. ..... 473/131; 206/315.9; 224/919; 221/307

[58] Field of Search ..... 273/131, 405; 206/315.9, 315.1; 224/918, 919; 221/303, 307, 308, 310, 312 A, 312 C

[56] References Cited

U.S. PATENT DOCUMENTS

| | | | |
|---|---|---|---|
| 1,718,952 | 7/1929 | Fischer | 206/315.9 |
| 4,850,483 | 7/1989 | Stack | 224/919 |
| 4,955,529 | 9/1990 | Barnhart | 206/315.9 |
| 5,040,675 | 8/1991 | Cleveland et al. | 206/315.9 |
| 5,147,101 | 9/1992 | Tiller . | |
| 5,183,154 | 2/1993 | Slemp | 221/307 |
| 5,191,995 | 3/1993 | McDonald . | |

*Primary Examiner*—Steven Wong
*Attorney, Agent, or Firm*—C. A. Rowley

[57] ABSTRACT

A ball dispenser is formed by a cylindrical housing or tube with a piston slidable therein and biased to a dispensing end of the tube. A cap is connected by a bridging member the tube and projects over the axial center line of the cylinder and is formed with a concave spherical shape to receive the end of a ball contained within the dispenser. The dispenser is symmetrical on opposite sides of a central plane and an assess opening of mouth is provided adjacent to the cap through the side of the tube opposite the bridging section. The mouth is symmetrical on opposite sides of the plane and has its maximum opening at the central plane. The periphery of the mouth is defined by substantially V-shaped sides on each side of the plane with the bottom of the V shapes adjacent to the bridging section. The front edge or lip of the cap i.e. at the plane overlying the mouth is closer to the cylindrical axis then the spherical radius of the ball to be dispensed so that the ball may be retained in the cap by the spring pressure on the piston and yet be easily withdrawn therefrom through the mouth or balls may be slid through the mouth with a rotating around the front lip of the cap.

4 Claims, 7 Drawing Sheets

BALL DISPENSER

FIELD OF INVENTION

The present invention relates to a ball dispenser, more particularly, the present invention relates to an elongated cylindrical ball dispenser specially suited for dispensing golf balls.

BACKGROUND OF THE INVENTION

There has been numerous different suggestions and patented devices for dispensing golf balls one at a time from a tubular housing. Some rely on spring biased pistons, others on gravity, none are particularly convenient to use which is the essence of the requirements for a satisfactory dispenser. Typical examples of golf ball dispensers are shown in U.S. Pat. No. 5,147,101 issued Sep. 15, 1992 to Tiller and U.S. Pat. No. 5,183,154 issued Feb. 2, 1993 to Slemp, both of which employ gravity as the means to deliver the ball to the dispensing end of the tube or U.S. Pat. No. 5,191,995 issued Mar. 9, 1993 to McDonald which employs a spring biased system for delivering balls to the dispensing opening. Generally each dispenser has some form of protruding lip for retaining the ball and preventing it from falling out and that is displaceable for dispensing of a ball.

None of these devices provide a relatively smooth operation and one wherein balls are firmly trapped in position so that they do not bounce or rattle, yet may be easily and positively dispensed from or inserted into the dispenser.

BRIEF DESCRIPTION OF THE PRESENT INVENTION

It is an object of the present invention to provide a ball dispenser that securely retains balls in position within the dispenser from which balls may be easily withdrawn.

Broadly, the present invention relates to a ball dispenser for storing and dispensing balls each having a spherical radius comprising a tube having a longitudinal axis and a substantially cylindrical inner wall surface centered on said axis, a cap at one axial end of said tube, said cap having a concave substantially spherical inner surface positioned directly over said longitudinal axis and facing said tube, said spherical surface having a spherical radius substantially equal to said spherical radius of said balls to be dispensed, a bridge connecting said cap with said tube, a mouth opening formed in said dispenser adjacent to said cap on a side of said dispenser opposite to and remote from said bridge, said mouth opening, said cap and said bridge being substantially symmetrical relative to a center plane extending along the longitudinal axis and dividing said dispenser into two substantially equal halves, said mouth opening having its periphery on each side of said plane shaped to define a V-shape, each said V shape tapering from a maximum opening of said mouth opening opposite said bridge to a mouth ending adjacent to said bridge, each said V shape being formed by a pair of side edges, one adjacent to said cap sloping toward said bridge and an end of the cylindrical housing remote from said cap and another remote from said cap sloping toward said bridge and said cap, ends of said one and said another side edge of each said pair remote from said maximum mouth opening being interconnected by a curved edge, said mouth opening having a dimension measured parallel to said longitudinal axis at least equal to twice said spherical radius of said balls and sufficient to permit one of said balls to pass therethrough and said cap having a lip formed at its end remote from said bridging section defining a portion of said periphery of said mouth opening at said plane and spaced from said cylindrical axis a distance less than spherical radius of said balls.

Preferably, a portion of said bridging section leading from said cap will have an internal radius substantially equal to said spherical radius of said balls and said inner cylindrical wall will have a radius larger than said spherical radius of said balls and a substantially conical section will interconnect said cylindrical wall and said portion.

Preferably said lip will have a concave guiding surface symmetrical relative to said plane to guide movement of balls into said dispenser.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
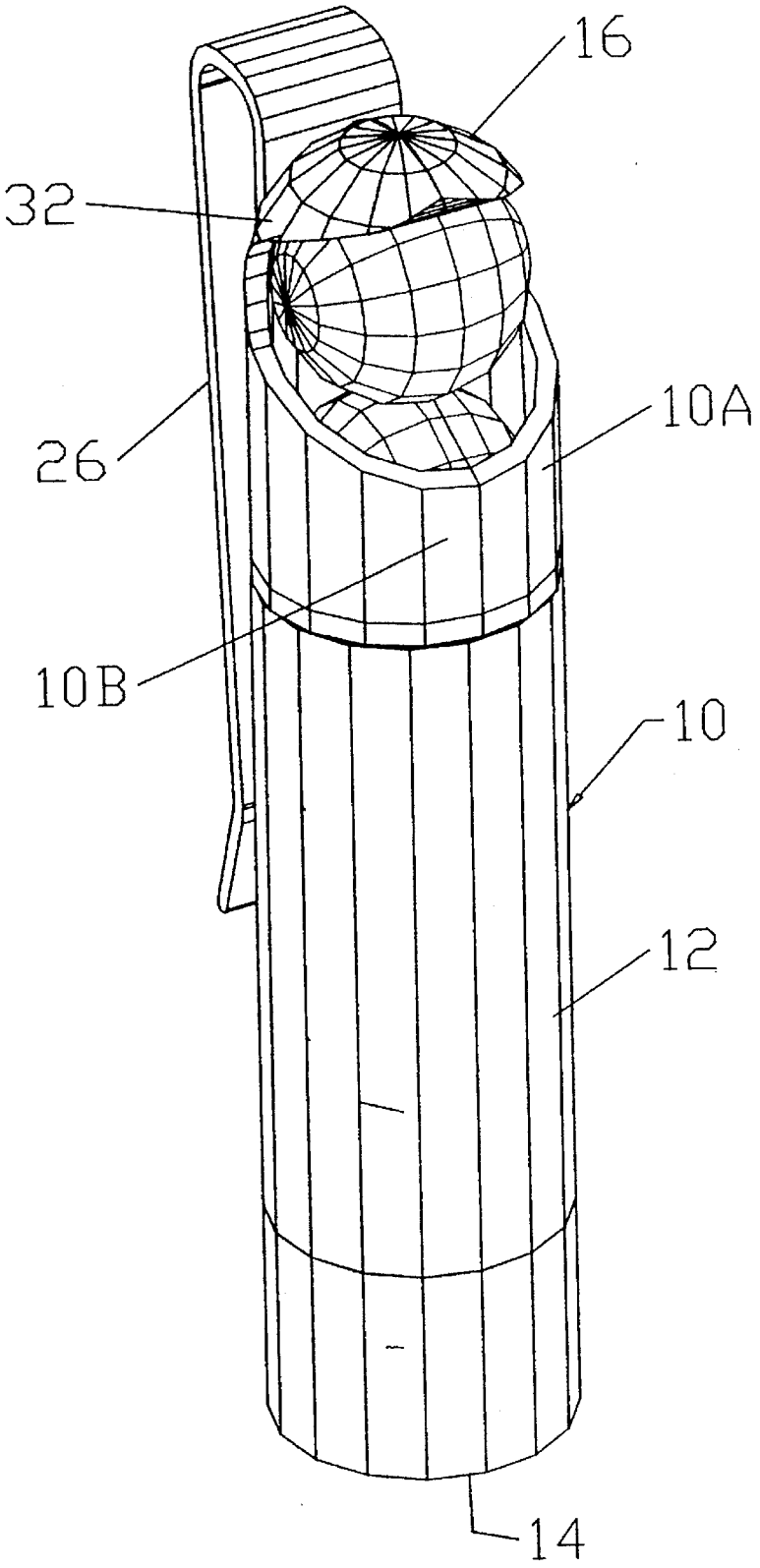
FIG. 1 is an isometric view showing the ball dispenser of the present invention.
Figure 2:
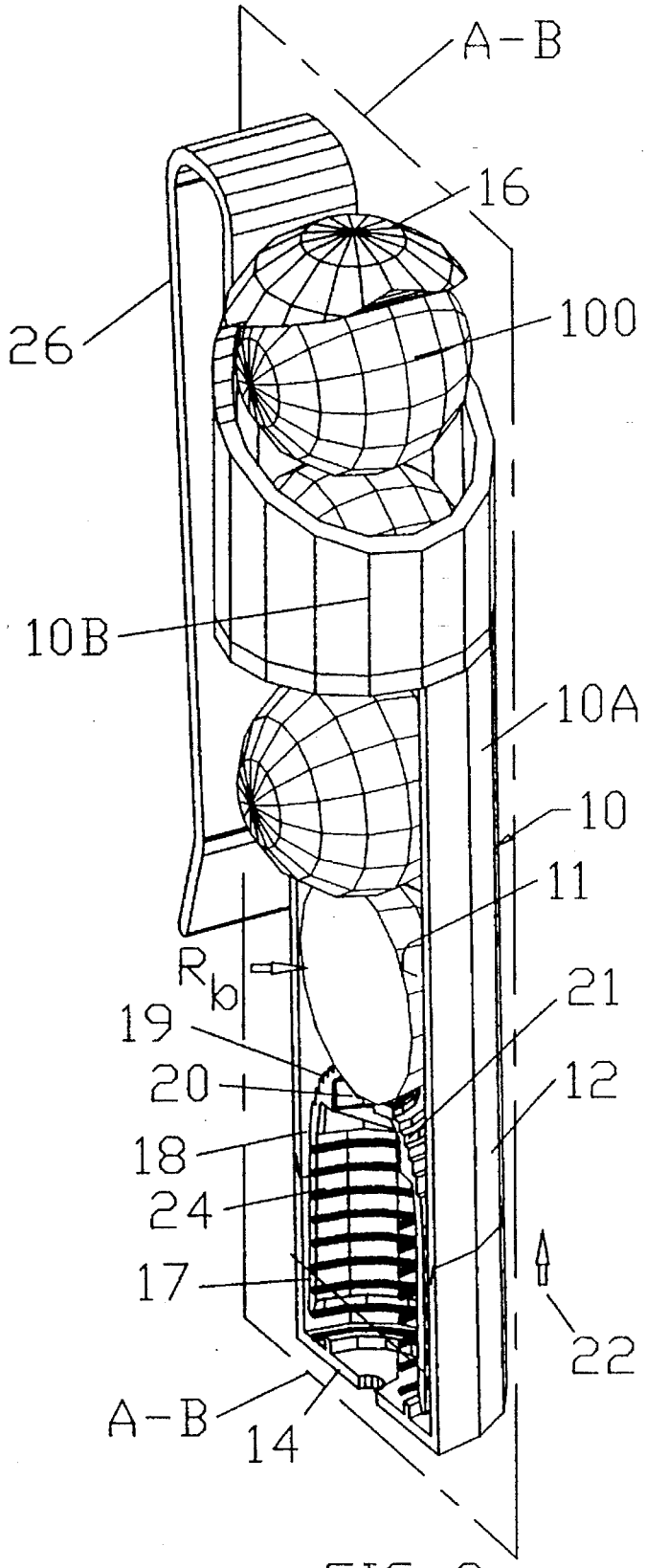
FIG. 2 is a view similar to FIG. 1 but showing part of the cylindrical housing cut away along a central plane of the dispenser.

As shown in FIGS. 1 and 2, the ball dispenser 10 includes a tube 12 having a cylindrical inner wall 11, a bottom 14 at one end of the tube 12 and a cap 16 connected via a bridging section 32 to the opposite end of the tube 12. A piston 18 (see FIG. 2) is slidable axially on the tube 12 to dispense the balls 100 as will be described below.

The piston 18 has a cylindrical bottom section 17 and a spherical top section 19 (adjacent to the cap 16). The section 19 preferably will have a shape resembling a ball 100 to be dispensed i.e. will have a spherical radius substantially the same as the spherical radius $R_b$ of the balls 100. The uppermost portion of the section 19 is formed with concave spherical surface 20 facing a cap 16 and also having a spherical radius substantially the same as the radius $R_b$ of the balls 100 so that the concave surface 20 may receive a portion of the periphery of the lowermost ball in the dispenser 12. Preferably the outer surface of the section 19 will be shaped to simulate a ball top be dispensed and for golf balls will preferably be provided with steps 21 concentric with and axially spaced relative to the longitudinal axis 200 of the dispensed 10. These steps facilitate displacement of the piston 18 by the insertion of a ball 100 when the dispenser 10 is empty.

Piston 18 is urged toward the cap 16, i.e. in the direction of the arrow 22 in FIG. 2 via a suitable spring such as the coil spring 24. The coil spring forces the piston 18 against the lowermost ball 100 to clamp the balls 100 in position between the piston 18 and the cap 16 regardless of the number of balls within the dispenser 10. When the piston 18 is moved by the spring 24 into its uppermost position (dispenser 10 is empty and contains no balls) the spherical surface 19 is received within the concave inner surface 30 of the cap 16, but is easily displaced therefrom by the insertion of balls into the dispenser in the same manner as additional ball are inserted when the dispenser 10 is partially full (as will be described below).

Any suitable means such as the spring hook 26 may be provided to hold the ball dispenser 10 in position, for example, on the golf cart or golf bag.

The dispenser 10 of the present invention operates in essentially the same manner requiring only slightly different pressure regardless of the number of balls retained in the tube 12. The dispenser is dimensioned based on the spherical radius $R_b$ of the balls to be stored and dispensed.

The inner wall surface 11 of the tube 12 has an inner cylindrical radius $R_c$ which is larger than the radius $R_b$ by a distance C which represents the clearance between the outer dimension of the balls 100 and the inner dimension of the inner wall 11 of the tube 12.

As can be seen, the longitudinal axis 200 of the dispenser extends essentially through the center of the tube 12 (i.e. the cylindrical axis of the inner wall 11), the piston 18 and each of the balls 100 although in view of the clearance C the balls 100 may lean slightly to bear the inner wall 11 of the tube 12. A central plane A-B (see FIGS. 2 and/or 7) divides the dispenser 10 into two substantially symmetrical halves 10A and 10B.

Figure 3:
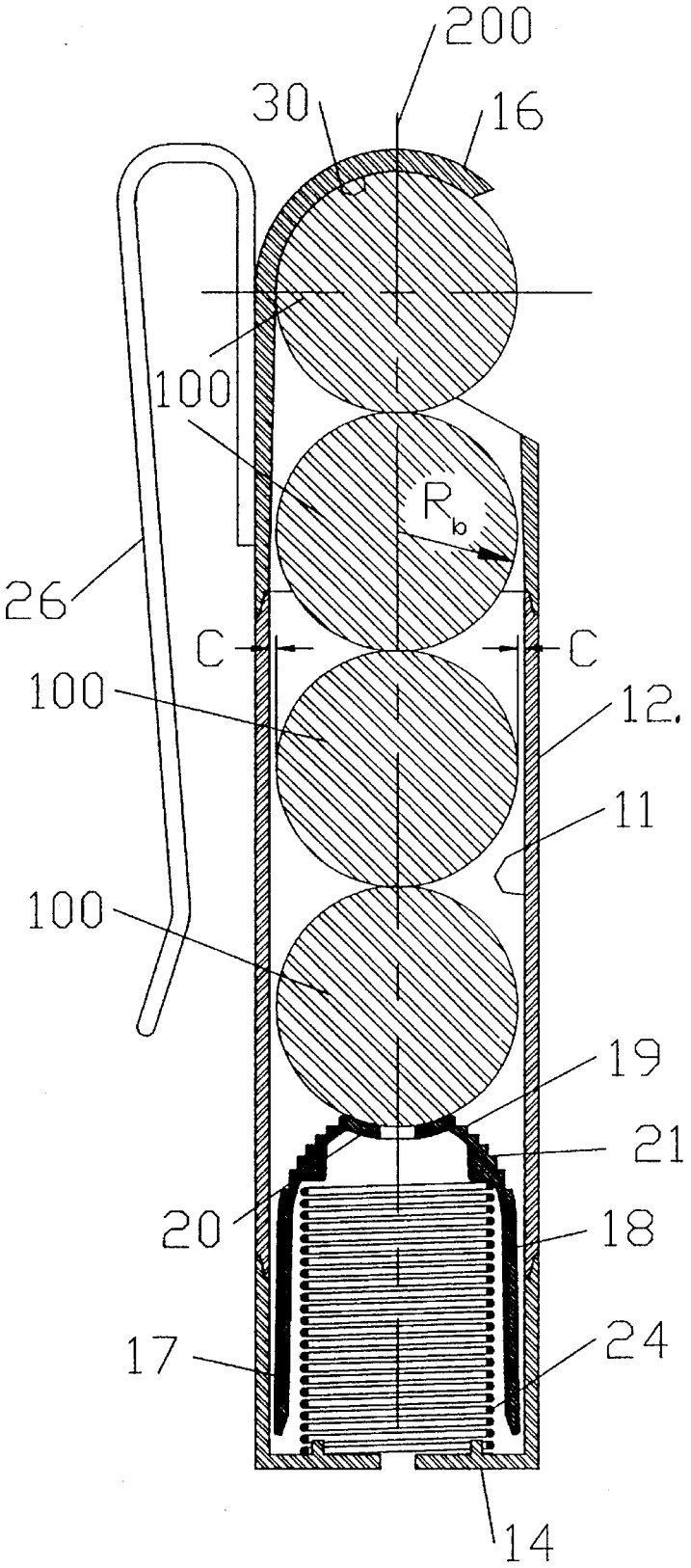
FIG. 3 is a longitudinal section along the central -plane A-B of a ball dispenser constructed in accordance with the present invention and showing the dispenser filled with balls.
Figure 4:
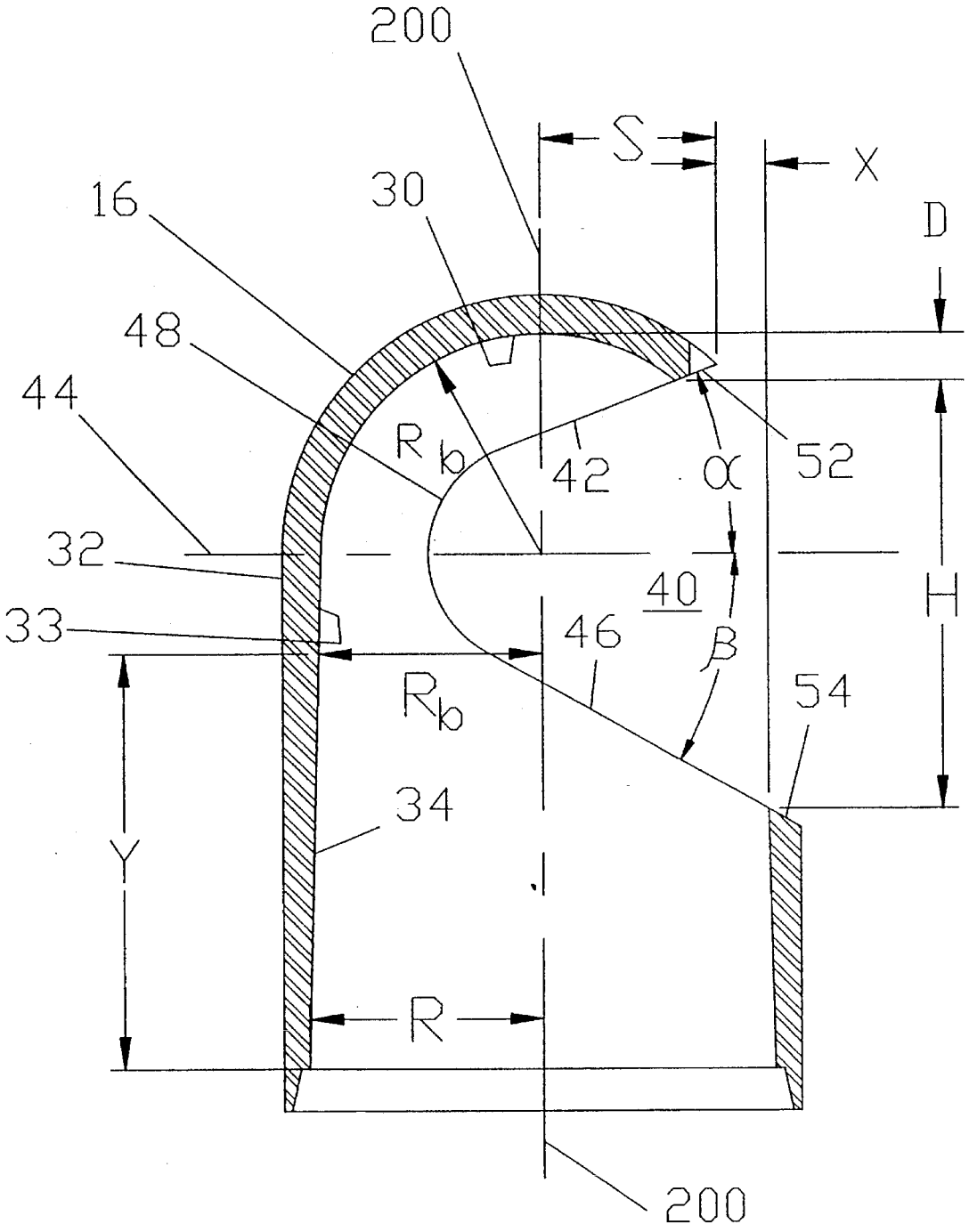
FIG. 4 is an enlarged section along the central -plane similar to FIG. 3 showing the cap section of the cylindrical housing.

As above indicated, the dispensing end of the tube 12, i.e. end of the dispenser 10, is formed by the cap 16 having an inner concave spherical surface 30 (see FIGS. 3, 4 or 5) The spherical radius indicated as $R_b$ (see FIG. 4) of surface 30 is essentially the same radius as the spherical radius $R_b$ of the balls i 00 and preferably is centered on the axis 200, but may be displaced slightly therefrom e.g. toward a bridging section 32 connecting the cap 16 to the remainder of the dispenser 10.

This radius $R_b$ is carried downwardly from the cap 16 as the inner surface of the dispenser 10 into the bridging section 32 and forms the cylindrical radius of a cylindrical inner surface 33 of a portion of the bridging section 32 axially spaced from the inner surface 30 by an axially distance at least equal to $R_b$. This portion of section 32 thus, has a radius smaller than the radius R of the cylindrical inner wall surface 11 and guides the balls as they approach the cap 16 to have their be center in alignment with the axis 200. The transition, i.e. reduction in radius, from radius R to radius $R_b$ in section 32 occurs over a tapering section 34 which extends axially along the tube 12 forms a frusta conical section 34 that gradually reduces the radius of the inner surface of the dispenser from the radius R in of the cylindrical wall 11 of the 12 to the radius $R_b$ of the inner surface 33 of the bridging member 32. The axial length of the section 34 as indicated by the dimension Y is approximately equal to one ball diameter i.e. Y equals about $2R_b$.

Opposite the bridging section 32 is the widest portion of the of a dispensing opening 40, the periphery of which is defined by the wall of the cylindrical section 12 symmetrically cut away to form substantially V-shape defining symmetrical boundaries of the mouth 40 on opposite sides of the central plane A-B. Each of the V shapes is defined by a first leg 42 adjacent to the cap 30 sloping toward the bridging member 32 and the bottom 14 at a first angle α to a plane 44 substantially perpendicular to the axis 200 and said plane A-B. The second leg 46 of each of the V shape slopes from the periphery of the tube 12 forming the widest portion of the mouth opening 40 toward the cap 30 and bridging section 32 at a second angle β to the plane 44. The ends of each pair of arms 42 and 46 on each side of the plane A-B are preferably interconnected by a substantially circular shaped arc 48 having a radius approximately equal to half the radius $R_b$ of the ball 100.

It will be apparent that the mouth 40 is defined on one side by one pair of arms 42 and 46 and an interconnecting arc 48, on one side of the central plane A-B and on the other side by a second pair of arms 42 and 46 and an interconnecting are 48 on the other side of the plane A-B, thus the mouth opening 40 is symmetrical on opposite sides of the plane A-B which in effect passes along the axis 200 and along the mid-line of the bridging section 32, mouth 40, tube 12 and cap 30 i.e. extends in the direction parallel to the axis 200 and divides the dispenser 10 into two symmetrical halves.

The angles α and β are set so that balls 100 may pass through the mouth 40 and with the angle β preferably slightly larger than angle α. For golf balls angles of approximately 20° and 30° respectively have been found satisfactory. In a specific embodiment of the present invention, for golf balls, α was set at 21° and β at 29°.

The height of the mouth opening at its maximum opening i.e. at the plane A-B as indicated by the dimension H, is generally about equal to the diameter of the ball and is sufficient to provide a very minor amount of clearance for withdrawal of a ball having one side immediately adjacent to the lip 52 of the cap 30.

The outer end or lip 52 of the cap 30, i.e. the maximum projection of the cap 30 away from the axis 200 in the plane A-B as indicated by dimension S is approximately half the ball radius $R_b$ from the axis 200 so that the edge 52 of the cap 30 is spaced inwardly by a distance X relative to the inside wall 11 of the tube 12.

It is also imperative that the lip or edge 52 is positioned closer to the bottom of the tube 12 than the point of intersection of the surface 30 and the axis 200 by a distance D sufficient to retain the balls in the dispenser 10 unless they are positively removed by a downward and forward movement. Generally the distance D will be approximately ¼ to ½ a ball radius $R_b$.

Figure 6:
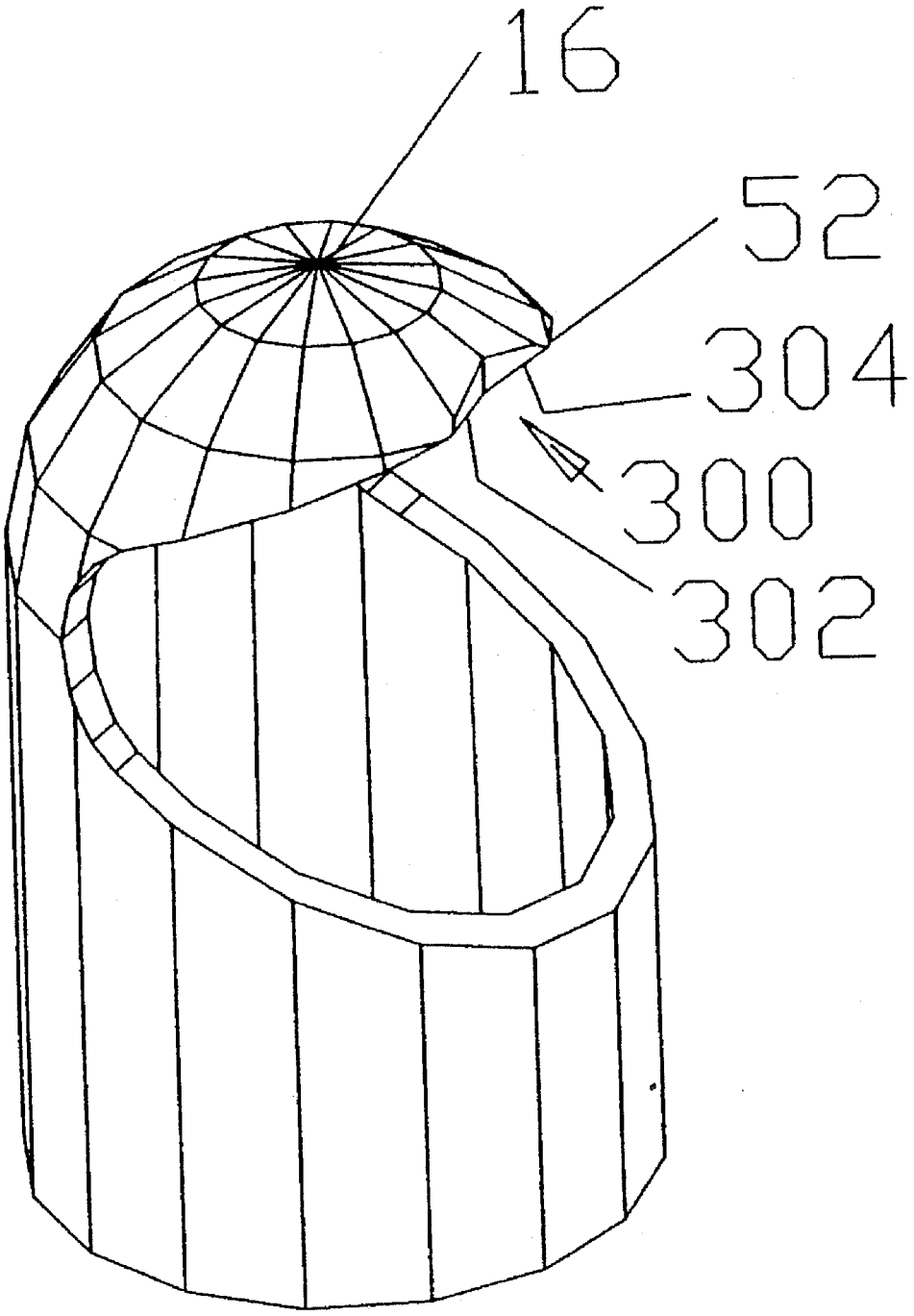
FIG. 6 is a illustration showing a ball guiding surface formed at the leading edge of the cap.
Figure 7:
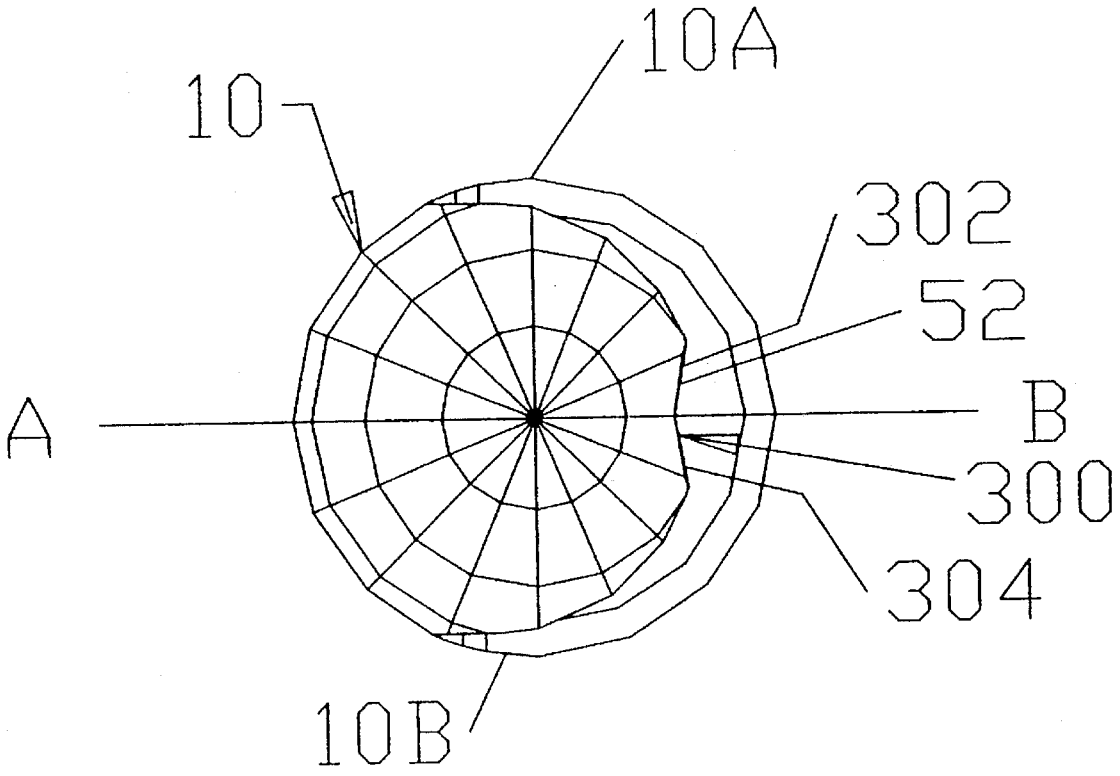
FIG. 7 is a plan view illustrating the position of the central plane A-B.

As shown in FIGS. 6 and 7, the front of the lip 52 of the cap 30 symmetrically on opposite sides of the plane A-B may be provided with a concave shape, the walls 302 and 304 of which form a guide to direct the ball into the casing of tube 12, i.e. the side edges 302 and 304 of the concave section 300 tend to engage the ball at spaced points around its periphery and center it on the plane A-B and thereby direct it into the housing or tube 12 with the ball's center moving in the plane A-B i.e. parallel to the axis 200.

This concave section 300 as shown as providing a V-shaped but it may also be simply concave curved and have a radius centered on the plane A-B having a radius substantially equal to the radius of the ball, i.e. equal to $R_b$.

Figure 5:
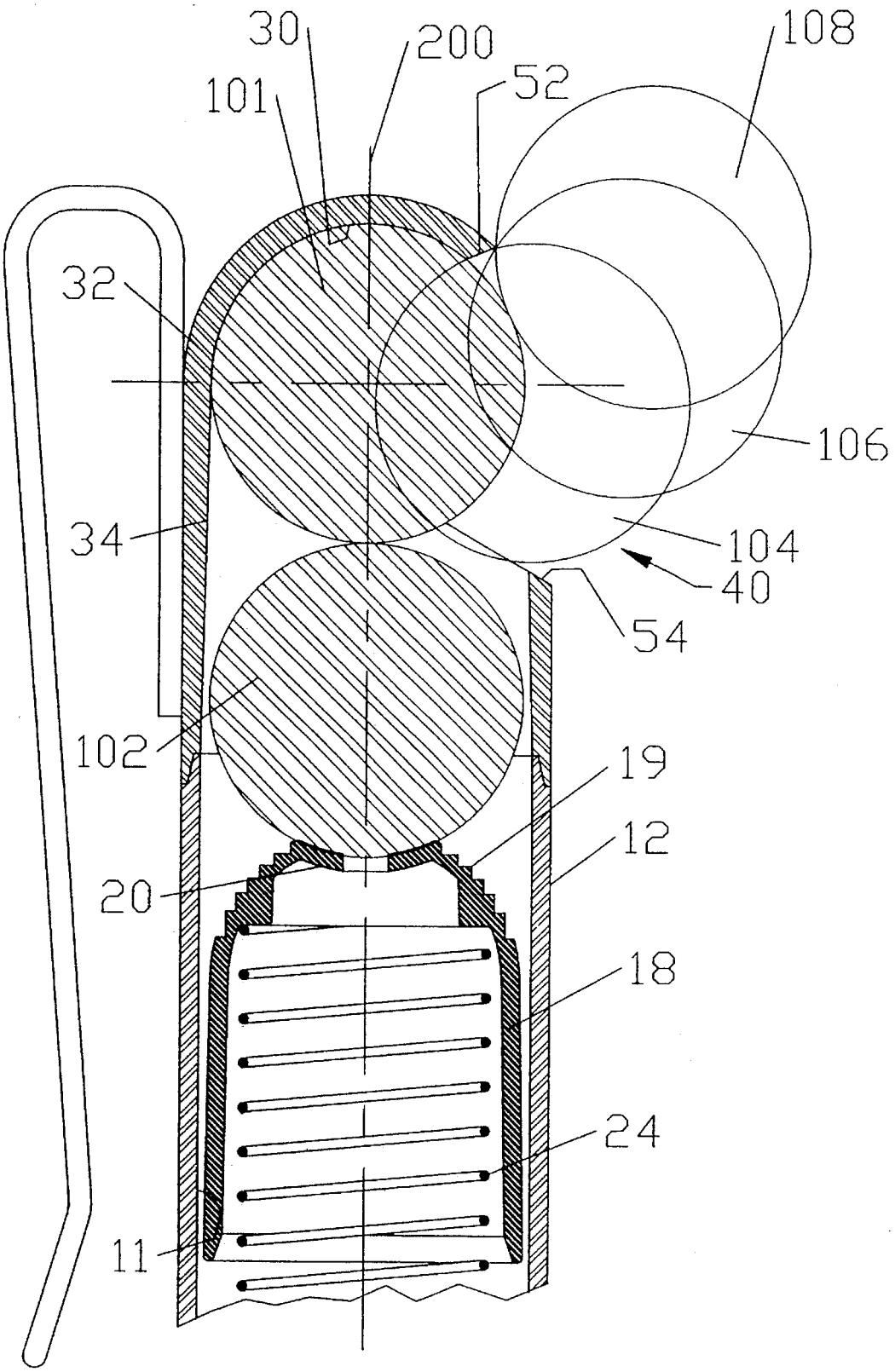
FIG. 5 is a partial view similar to FIG. 3 illustrating the movement of the ball to enter or leave through the mouth of the dispenser.

In operation to insert or withdraw a ball 100 is shown in FIG. 5, showing a ball in various positions as it enters the dispenser 10. The ball is rolled under the lip 52, preferably while being centered on the plane A-B by the side edges 302 and 304, but in any event as it rolls in, it moves in a manner to clear the bottom edge 54 of the mouth opening 40 to enter the dispenser 10. Obviously, as the ball enters, the uppermost ball, i.e. ball 101 in FIG. 5 must move down and be forced to the position of ball 102 by the incoming ball 104. Thus, the forces on the top ball 101 press it downwardly in FIG. 5 and rearwardly toward the bridging member 32 so that the ball 101 rides along the section 34 and moves downwardly into the tube 12. When no balls are in the dispenser the first ball to be inserted engages the spherical section 19 of the piston 18 on the steps 21 to in a similar manner move the piston 18 downward toward the bottom 14.

On the other hand, when a ball is to be removed, it is gripped through the V shaped opening at the sides of the mouth 40 and moved downwardly and rolled around the lip 52 in the manner indicated by the positions of the balls 101, 104, 106, 108 so that the ball is relatively easily withdrawn and as it is withdrawn, the next lower ball moves into position into the concave cap 30 via the spring 24 moving the piston upward.

The provision of a concave inner surface 30 matching with the ball radius in the cap 30 and the concave section 20 and the piston 18 ensures that when only a single ball is present in the dispenser, the ball is trapped within the dispenser due to its position in the concave cap 30 and its lower end being received within the concave indentation 20 it cannot move lateral out of the dispenser without first moving axially of the dispenser 10 i.e. along the axis 200 toward the bottom 14.

When the dispenser 10 is empty the spherical section 19 of the piston 18 is forced by the spring 24 against the concave surface 30 of the cap 16 and since both have essentially the same spherical radius the section 19 comfortably nests within the cap 16 when the dispenser 10 is empty.

Having described the invention, modifications will be evident to those skilled in the art without departing from the scope of the invention as defined in the appended claims.

I claim:

1. A ball dispenser for storing and dispensing balls each having a spherical radius comprising a tube having a longitudinal axis and a substantially cylindrical inner wall surface centered on said axis, a cap at one axial end of said tube, said cap having a concave substantially spherical surface positioned directly over said longitudinal axis and facing said tube, said spherical surface having a spherical radius substantially equal to said spherical radius of said balls to be dispensed, a bridge connecting said cap with said tube, a mouth opening formed in said dispenser adjacent to said cap on a side of said dispenser opposite to and remote from said bridge, said mouth opening, said cap and said bridge being substantially symmetrical relative to a center plane extending along the longitudinal axis and dividing said dispenser into two substantially equal halves, said mouth opening having its periphery on each side of said plane shaped to define a V-shape, each said V shape tapering from a maximum opening of said mouth opening opposite said bridge to a mouth ending adjacent to said bridge, each said V shape being formed by a pair of side edges, one adjacent to said cap sloping toward said bridge and an end of the cylindrical housing remote from said cap and another remote from said cap sloping toward said bridge and said cap, ends of said one and said another side edge of each said pair remote from said maximum mouth opening being interconnected by a curved edge, said mouth opening having a dimension measured parallel to said longitudinal axis at least equal to twice said spherical radius of said balls and sufficient to permit one of said balls to pass therethrough and said cap having a lip formed at its end remote from said bridging section defining a portion of said periphery of said mouth opening at said plane and spaced from said cylindrical axis a distance less than spherical radius of said balls.

2. A ball dispenser as defined in claim 1 wherein a portion of said bridging section leading from said cap has an internal radius substantially equal to said spherical radius of said balls and said inner cylindrical wall has a radius larger than said spherical radius of said balls and a substantially conical section interconnecting said cylindrical wall and said portion.

3. A ball dispenser as defined in claim 1 wherein said lip has a concave guiding surface symmetrical on opposite sides of said plane to guide said balls into said dispenser.

4. A ball dispenser as defined in claim 2 wherein said lip has a concave guiding surface symmetrical on opposite sides of said plane to guide said balls into said dispenser.

* * * * *